US006662762B2

(12) United States Patent
Schuko

(10) Patent No.: US 6,662,762 B2
(45) Date of Patent: Dec. 16, 2003

(54) BALANCED FIVE CYCLE ENGINE WITH SHORTENED AXIAL EXTENT

(76) Inventor: Leonhard Schuko, 100 Roselena Dr., Schomberg, Ontario (CA), L0G 1T0

( * ) Notice: Subject to any disclaimer, the term of this patent is extended or adjusted under 35 U.S.C. 154(b) by 5 days.

(21) Appl. No.: 10/074,261

(22) Filed: Feb. 14, 2002

(65) Prior Publication Data

US 2003/0150410 A1 Aug. 14, 2003

(51) Int. Cl.[7] ..... F02B 75/18
(52) U.S. Cl. ..... 123/56.1
(58) Field of Search ..... 123/56.1, 56.2, 123/56.3, 56.4, 56.5, 56.6, 56.7, 56.8, 56.9, 64, 51 BD, 51 B, 51 A, 51 BA, 51 AA

(56) References Cited

U.S. PATENT DOCUMENTS

| | | | | |
|---|---|---|---|---|
| 1,788,140 A | | 1/1931 | Woolson | |
| 1,808,083 A | | 6/1931 | Tibbetts | |
| 3,312,206 A | | 4/1967 | Radovic | |
| 5,031,581 A | * | 7/1991 | Powell | 123/51 B |
| 5,289,802 A | * | 3/1994 | Paquette et al. | 123/18 A |
| 5,743,220 A | * | 4/1998 | Guarner-Lans | 123/56.9 |
| 6,098,578 A | * | 8/2000 | Schuko | 123/56.5 |
| 6,250,264 B1 | * | 6/2001 | Henriksen | 123/56.2 |
| 6,305,334 B1 | | 10/2001 | Schuko | |

FOREIGN PATENT DOCUMENTS

| | | |
|---|---|---|
| EP | 0 153 528 | 9/1985 |
| EP | 0 357 291 | 3/1990 |
| WO | WO 93/05290 | 3/1993 |

* cited by examiner

*Primary Examiner*—Henry C. Yuen
*Assistant Examiner*—Hyder Ali
(74) *Attorney, Agent, or Firm*—Pillsbury Winthrop LLP

(57) ABSTRACT

A five-cycle internal combustion engine in which the transfer cycle movements of the inlet and outlet pistons in the first cylinders are accompanied by a generally equal and axially opposite transfer cycle movement of the inlet and outlet pistons in the second cylinders so that all transfer cycle movements are axially balanced. Also disclosed is an improvement providing a compression ratio adjusting system constructed and arranged to effect axial movement between the cooperating inlet and outlet cams so as to vary the spacing between the inlet and outlet pistons in each cylinder at the combustion position thereof so as to vary the minimum volume condition defined thereby in relation to the volume defined by the compression position thereof.

30 Claims, 11 Drawing Sheets

BALANCED FIVE CYCLE ENGINE WITH SHORTENED AXIAL EXTENT

This invention relates to internal combustion engines and more particularly to improvements in five cycle engines embodying annularly arranged cylinders having opposed pistons movable by annular cams.

BACKGROUND OF THE INVENTION

Five cycle engines of the type herein contemplated have been proposed in the patented literature for more than sixty-eight years. The Packard Motor Car Co. was granted U.S. Pat. No. 1,788,140, on Jan. 6, 1931, which discloses the basic five cycle engine herein contemplated.

The '140 patent discloses an internal combustion engine comprising a housing, a plurality of annularly arranged cylinders in the housing disposed with their axes parallel with a central longitudinal rotor axis. Each of the cylinders includes an inlet end portion having an inlet port therein, a central working portion, and an outlet end portion having an outlet port therein. An inlet piston is mounted in each cylinder constructed and arranged to be moved in sealing relation to the associated cylinder from an inlet end position wherein the inlet port thereof communicates with the working portion thereof in an axial direction away from the inlet end position into an inlet port cut-off position wherein the inlet piston cuts off communication of the inlet port thereof with the working portion thereof and beyond into the working portion thereof. An outlet piston is mounted in each cylinder constructed and arranged to be moved in sealing relation to the associated cylinder from an outlet end position thereof wherein the outer port thereof is communicated with the working portion thereof in an axial direction away from the outlet end position into an outlet port cut-off position wherein the outlet piston cuts off the communication of the outer port thereof with the working portion thereof and beyond into the working portion thereof. Rotor structure within the housing is constructed and arranged to move with a rotational movement within the housing about the central rotor axis. Each of the inlet pistons includes an inlet cam follower constructed and arranged to follow an annular inlet cam during the rotation of the rotor structure. Each of the outlet pistons includes an outlet cam follower constructed and arranged to follow an annular outlet cam during the rotation of the rotor structure. The inlet and outlet annular cams are configured to move the inlet and outlet pistons within each cylinder through a successive five-cycle repeating movement which includes (1) a power cycle wherein the inlet and outlet pistons are moved axially outwardly from combustion positions disposed in closely spaced relation within the working portion of the associated cylinder into the respective cut-off positions thereof, (2) an exhaust cycle wherein the outlet piston is moved from the outer cut-off position thereof into the outlet end position thereof and the inlet piston is moved through the working portion thereof into close proximity to the outlet piston, (3) a transfer cycle wherein the inlet and outlet pistons are moved together in close proximity to each other through the working portion thereof, (4) an intake cycle wherein the outlet piston is initially moved through the working portion of the associated cylinder while the inlet piston is in a position allowing communication of the inlet port with the working portion with the final movement of the intake cycle resulting in the inlet and outlet pistons being in compression positions spaced from the respective end positions thereof so that the communication of the respective ports are cut off from the working portion of the associated cylinder, and (5) a compression cycle wherein the inlet and outlet pistons are moved from the compression positions thereof toward each other into the combustion positions.

The '140 patent disclosure contemplates that the compression positions of the inlet and outlet pistons in the intake cycle constitute the respective cut-off positions thereof, both of which are moved directly therein during the final movements of the intake cycle. In this way, a maximum power is achieved and opposed piston movement balance is achieved during the full movement of the opposed pistons during compression as well as during expansion.

It is noted, however, that the transfer cycle introduces an imbalance because both pistons are moved together through a stroke from the outlet to inlet end positions. Similarly, the intake and exhaust cycles involve different movements of the pistons in the same direction.

Over the years, there have been various improvements on the basic five cycle engine proposed in the patented literature. The Packard Motor Car Co. was granted improvement U.S. Pat. No. 1,808,083, contemporaneously with the basic '140 patent on June 2, 1931. This Packard improvement was directed toward diminishing the imbalanced movement of the pistons together during the transfer cycle by essentially halving the movement required and doubling the five cycle operation to a ten cycle operation.

U.S. Pat. No. 5,289,802 introduced two features of improvement in the basic five-cycle operation. First, an increased compression-expansion ratio beyond one is proposed where the compression positions of the inlet and outlet pistons in the intake cycle constitute the cut-off position of the inlet piston and an intermediate position of the outlet piston disposed inwardly of the outlet cut-off position thereof, both of which are moved directly therein during the final movements of the intake cycle. The intake cycle is essentially accomplished by a movement of the outlet piston within the cylinder which positively displaces a new charge through the open inlet port. Second, the inlet and outlet pistons dwell in the combustion positions thereof longer than the instantaneous dwell provided by simple harmonic motion for a time sufficient to enable a new fueled gas charge within the minimum column to be ignited and to rise to maximum pressure before substantial volume increase toward the maximum volume during the power cycle takes place to thereby eliminate negative work resulting from ignition prior to reaching the minimum volume condition and to obtain optimal work from optimal pressure conditions.

While these improvements to some extent have a positive effect on the inherent imbalance of the basic five-cycle movement, it is apparent that the problem of inherent imbalance has gone unsolved since 1931 despite the various improvements which have been proposed over the years.

My U.S. Pat. No. 6,305,334 discloses one way of achieving balance in a five-cycle engine. The manner of achieving balance is to construct a mirror image of the engine. In this way, all movements of the initial engine pistons and cam followers are accompanied by an equal and opposite movement of the mirror image engine pistons and cam followers. While balance is achieved, the resultant construction is a total engine which is elongated in the axial direction by a factor of two. In many installations, the axial length of the engine becomes prohibitive to usage. An example exists in many automobiles. There still exists a need for a solution to the balance problem which does not create the elongation problem of the mirror image solution of the '334 patent.

BRIEF SUMMARY OF THE INVENTION

An objective of the present invention is to supply the need expressed above. In accordance with the principles of the present invention, this objective is accomplished by providing a five-cycle internal combustion engine having the usual components wherein a plurality of first cylinders and a plurality of second cylinders having axes disposed in annularly spaced relation about the longitudinal axis of the housing assembly and in annularly spaced relation with respect to one another. The inlet and outlet end portions of the first cylinders are arranged in axially opposite relation with respect to the inlet and outlet end portions of the second cylinders respectively. The first and second inlet and outlet cams associated with the first and second cylinders respectively are related to each other so that the transfer cycle movements of the inlet and outlet pistons in the first cylinders are accompanied by a generally equal and axially opposite transfer cycle movement of the inlet and outlet pistons in the second cylinders so that all transfer cycle movements of the first and second inlet and outlet pistons and the associated first and second inlet and outlet cam followers are axially balanced.

The present invention also contemplates an improvement capable of varying the compression ratio of the five cycle engine discussed above as well as other five cycle engines. This capability is achieved by providing a compression ratio adjusting system constructed and arranged to effect axial movement between the cooperating inlet and outlet cams so as to vary the spacing between the inlet and outlet pistons in each cylinder at the combustion position thereof so as to vary the minimum volume condition defined thereby in relation to the volume defined by the compression position thereof.

DETAILED DESCRIPTION OF THE PREFERRED EMBODIMENTS OF THE INVENTION

Figure 1:
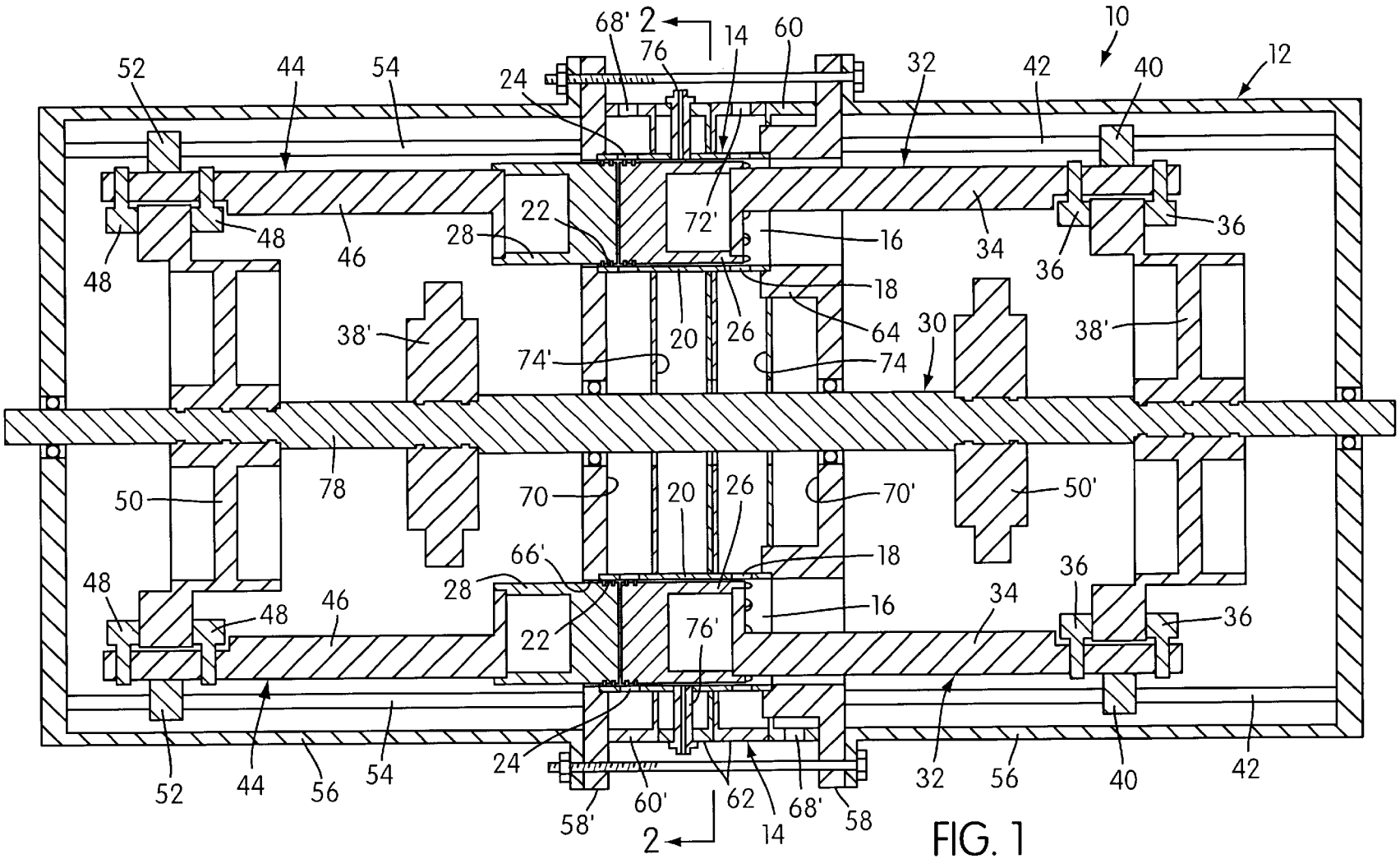
FIG. 1 is a longitudinal sectional view of a balanced five-cycle eight cylinder internal combustion engine embodying the principles of the present invention, the background structure not in section being eliminated for purposes of clearer illustration.
Figure 2:
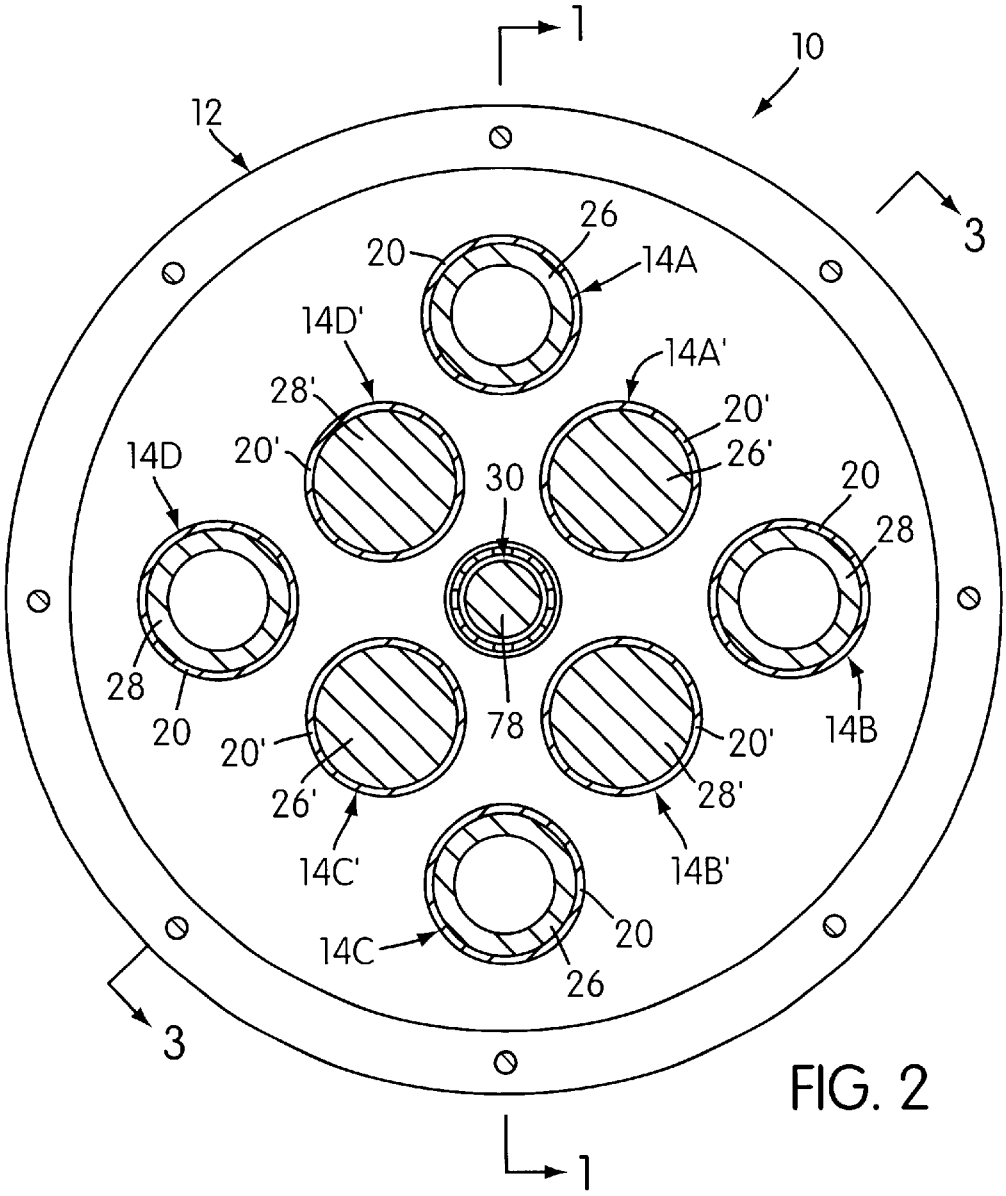
FIG. 2 is a sectional view taken along the line 2—2 of FIG. 1.
Figure 3:
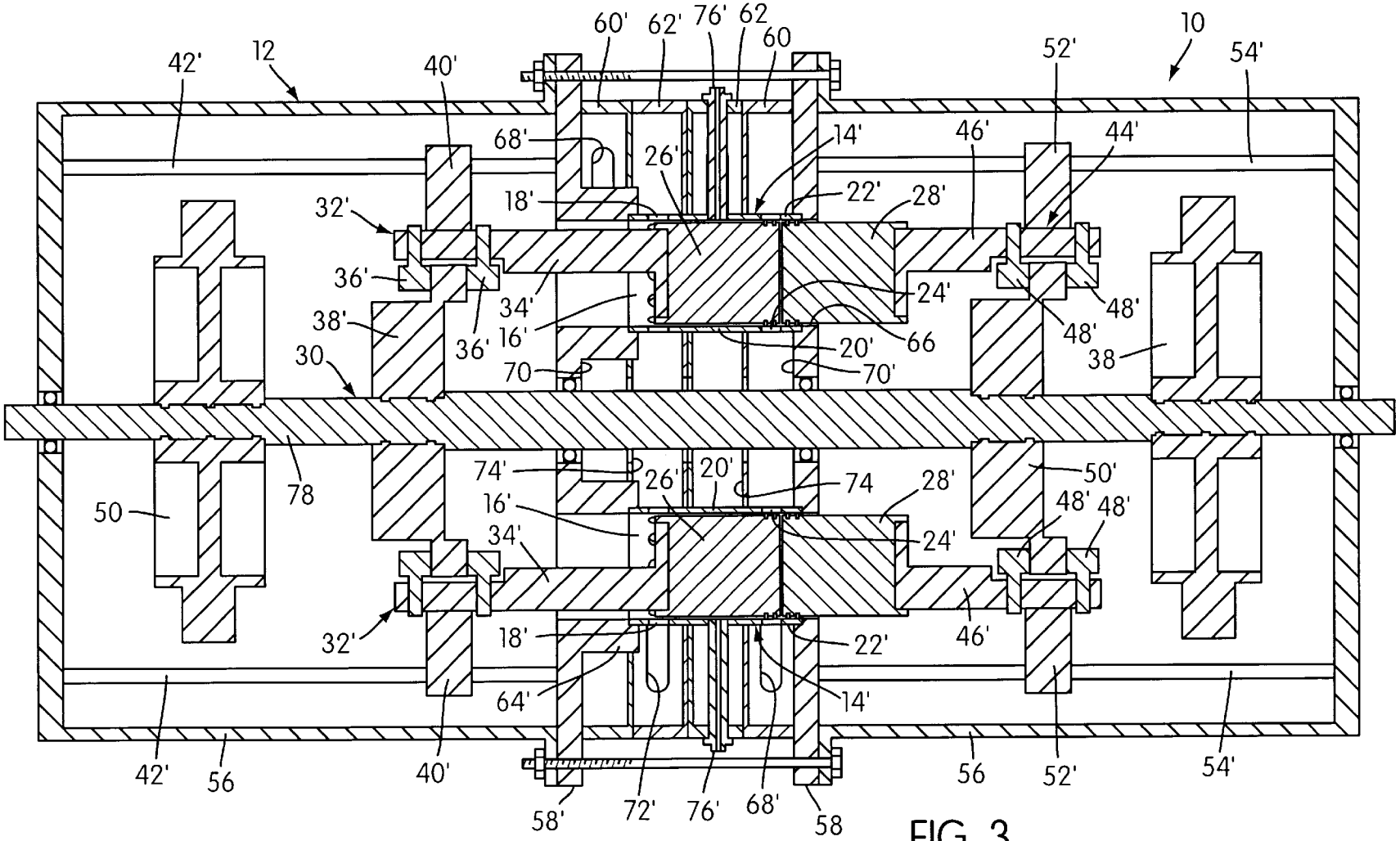
FIG. 3 is a view similar to FIG. 1 taken along the line 3—3 of FIG. 2.

Referring now more particularly to FIGS. 1–3 of the drawings, there is shown therein a balanced five-cycle combustion engine, generally indicated at 10, embodying the principles of the present invention.

The engine 10 includes a housing assembly 12, having a longitudinal axis. Within the housing assembly 12, is a plurality of annularly arranged first cylinders, generally indicated at 14, having axes which are disposed in an annularly spaced parallel relation with respect to the longitudinal axis. A plurality of second cylinders 14' are arranged in annularly spaced parallel relation with respect to the longitudinal axis and in annularly spaced relation with respect to the plurality of first cylinders 14. Preferably, the second cylinders 14' are disposed in generally axial coextensive relation with respect to the axes of the first cylinders 14. As best shown in FIG. 2, the first cylinders 14 have their axes disposed within an outer circle. The second cylinders 14' have their axes interposed therebetween within an inner circle.

Each first cylinders 14 has an inlet end portion 16 having one or more inlet ports 18 therein, a central working portion 20, and an outlet end portion 22 having one or more outlet ports 24 therein. Each of the plurality of second cylinders 14' has an inlet end portion 16' having one or more inlet ports 18' therein, a central working portion 20', and an outlet end portion 22' having one or more outlet ports 24' therein. The inlet end portion 16, the central working portion 20, and the outlet end portion 22 of the first cylinders 14 are arranged in axially opposite relation with respect to the inlet end portion 16', the central working portion 20', and the outlet end portion 22' of the plurality of second cylinders 14' respectively.

A first inlet piston 26 is mounted in each of the first cylinders 14. Each first inlet piston 26 is constructed and arranged to be moved in sealing relation to the associated first cylinder 14 from an inlet end position wherein the inlet port 18 thereof communicates with the working portion 20 thereof. Each first inlet piston 26 moves in an axial direction away from the inlet end position thereof into an inlet port cut-off position wherein the first inlet piston 26 cuts off communication of the inlet port 18 of the first cylinder 14 with the working portion 20 thereof and beyond into the working portion 20 thereof.

A second inlet piston 26' is mounted in each second cylinders 14'. Each second inlet piston 26' is constructed and arranged to be moved in sealing relation to the associated second cylinder 14' from an inlet end position wherein the inlet port 18' thereof communicates with the working portion 20' thereof. Each second inlet piston 26' moves in an axial direction away from the inlet end position thereof into an inlet port cut-off position wherein the second inlet piston 26' cuts off communication of the inlet port 18' of the associated second cylinder 14' with the working portion 20' thereof and beyond into the working portion 20' thereof.

A first outlet piston 28 is mounted in each first cylinder 14 and is constructed and arranged to be moved in sealing relation thereto from an outlet end position wherein the outlet port 24 thereof communicates with the working portion 20 thereof. Each first outlet piston 28 moves in an axial direction away from the outlet end position thereof into an outlet port cut-off position wherein the first outlet piston 28 cuts off the communication of the outlet port 24 of the associated first cylinder 14 with the working portion 20 thereof and beyond into the working portion 20 thereof.

A second outlet piston 28' is mounted in each second cylinder 14' and is constructed and arranged to be moved in sealing relation thereto from an outlet end position wherein the outlet ports 24' thereof communicate with the working portion 20' thereof Each second outlet piston 28' moves in an axial direction away from the outlet end position thereof into an outlet port cut-off position wherein the outlet piston 28' cuts off the communication of the outlet port 24' of the associated second cylinder 14' with the working portion 20' thereof and beyond into the working portion 20' thereof.

A rotor structure, generally indicated at 30, is mounted within the housing assembly 12 and is constructed and arranged for rotational movement therein about the longitudinal axis.

Each of the first inlet pistons 26 has connected thereto a first inlet cam follower, generally indicated at 32, which preferably is in the form of a fixed piston rod 34 having a pair of axially spaced rollers 36 on the free end thereof constructed and arranged to follow a first annular outlet cam 38, disposed annularly about the longitudinal axis axially outwardly of the inlet end portions 16 of the first cylinders 14.

Each of the second inlet pistons 26' has connected thereto a second inlet cam follower, generally illustrated at 32', which preferably is in the form of a fixed piston rod 34' having a pair of axially spaced rollers 36' constructed and arranged to follow a second annular inlet cam 38', disposed annularly about the longitudinal axis axially outwardly of the inlet end portions 16' of the second cylinders 14' during the rotation of rotor structure 30 so as to effect axial movements thereof in opposite directions.

The first and second inlet cam followers 32 and 32' are guided for longitudinal rectilinear movement by guide blocks 40 and 40' respectively which, as shown, are fixed to the free ends of the piston rods 34 and 34' of the first and second inlet cam followers 32 and 32' respectively. Each guide block 40 is slidably mounted on a pair of longitudinally extending guide rods 42 suitably fixed to the housing assembly 12. Each guide block 40' is slidably mounted on a pair of longitudinally extending guide rods 42' suitably fixed to the housing assembly 12.

Each of the first outlet pistons 28 has connected thereto a first outlet cam follower, generally indicated at 44, which preferably is in the form of a fixed piston rod 46 having a pair of axially spaced rollers 48 on the free end thereof constructed and arranged to follow a first annular outlet cam 50, disposed annularly about the longitudinal axis axially outwardly of the outlet end portion 22 of the first cylinders 14 during the rotation of rotor structure 30 so as to effect axial movements thereof in opposite directions.

Each of the second outlet pistons 28' has connected thereto a second outlet cam follower, generally indicated at 44', which preferably is in the form of a fixed piston rod 46 having a pair of axially spaced rollers on the free end thereof constructed and arranged to follow a second annular outlet cam 50', disposed annularly about the longitudinal axis axially outwardly of the outlet end portions 22' of the second cylinders 14' during the rotation of rotor structure 30 so as to effect axial movements thereof in opposite directions.

The first and second outlet cam followers 44 and 44' are guided for longitudinal rectilinear movement by guide blocks 52 and 52' respectively which, as shown, are fixed to the free ends of the piston rods 46 and 46' of the first and second outlet cam followers 44 and 44' respectively. Each guide block 52 is slidably mounted on a pair of longitudinally extending guide rods 54 suitably fixed to the housing assembly 12. Each guide block 52' is slidably mounted on a pair of longitudinally extending guide rods 54' suitably fixed to the housing assembly 12.

The first inlet and outlet annular cams, 34, 34' and 38, 38', are configured to move the first and second inlet and outlet pistons, 26, 26' and 28, 28' within each first and second cylinder 14, 14' through a successive five-cycle repeating movement set forth below.

(1) a power cycle wherein the first and second inlet and outlet pistons, 26, 26' and 28, 28', are moved axially outwardly from combustion positions disposed in closely spaced relation within the working portion 20, 20' of the associated cylinder 14, 14' defining a minimum volume condition into the respective cut-off positions thereof defining a maximum volume condition;

(2) an exhaust cycle wherein the first and second outlet pistons 28, 28' are moved from the outlet cut-off position thereof into the outlet end positions thereof and the first and second inlet pistons 26, 26' are moved through the working portion 20, 20' thereof into close proximity to the first and second outlet pistons 28, 28';

(3) a transfer cycle wherein the first and second inlet and outlet pistons, 26, 26' and 28, 28', are moved together in close proximity to each other through the working portion 20, 20' of the associated first and second cylinders 14, 14'.

(4) an intake cycle wherein the first and second outlet pistons 28, 28' are initially moved through the working portions 20, 20' of the associated first and second cylinders 14, 14' while the first and second inlet pistons 26, 26' respectively are in positions allowing communication of the first and second inlet ports 18, 18' respectively with the associated working portions 20, 20' with the final movement of the intake cycle resulting in the first and second inlet and outlet pistons, 26, 26', and 28, 28' being in compression positions spaced from the respective end positions thereof so that the communication of the respective inlet and outlet ports 18, 18', and 24, 24' are cut off from the working portions 20, 20' of the associated first and second cylinders 14, 14';

and (5) a compression cycle wherein the first and second inlet and outlet pistons, 26, 26' and 28, 28' are moved from the compression positions thereof toward each other into the combustion positions thereof.

Figure 4:
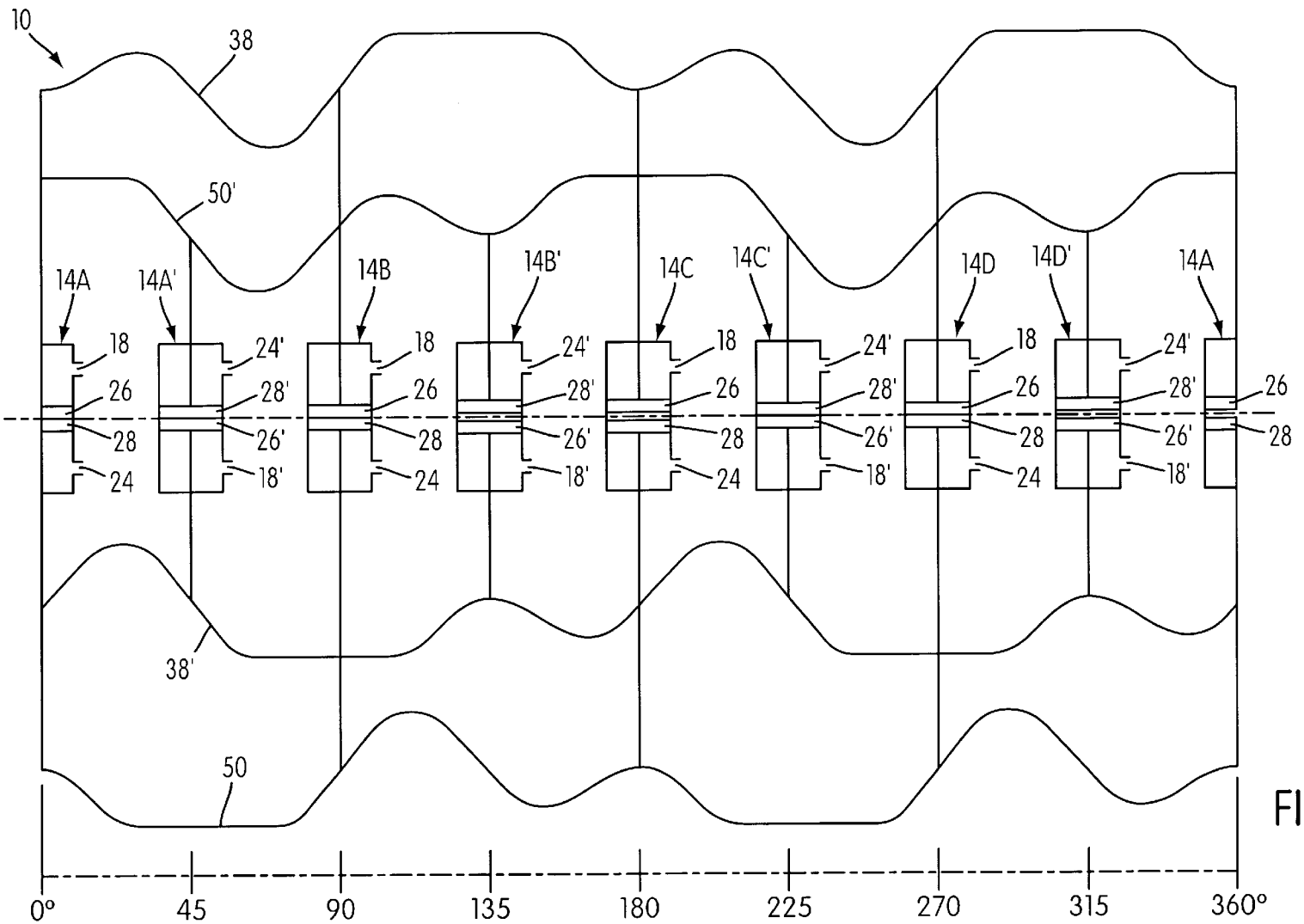
FIG. 4 is a view showing the relationship between the cam surfaces of the first and second inlet and outlet cams and one position of the first and second inlet and outlet pistons in the eight first and second cylinders.
Figure 5:
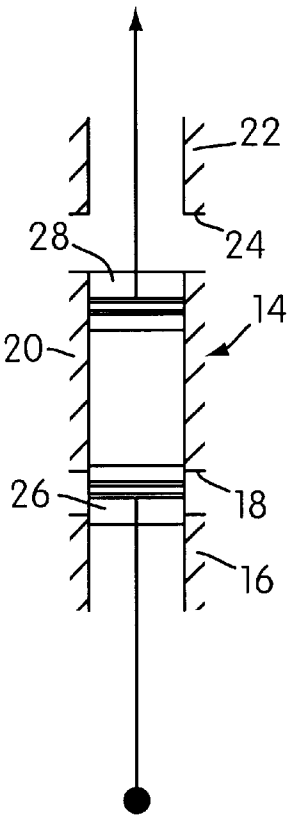
FIG. 5 is a somewhat schematic view of a pair of inlet and outlet pistons within a cylinder in the combustion position thereof achieved by the inlet and outlet cam configuration shown in FIG. 4.

In the configuration shown in FIG. 4, the compression position of each outlet piston 28 and 28' is as shown in FIG. 5 inwardly of the cut-off position thereof. In reaching this compression position, each outlet piston 28 and 28' is moved directly into the compression position shown during the final movement of the intake cycle. In addition, the cam configuration is such as to accomplish a piston dwell in the combustion position.

The preferred engine 10 shown in FIGS. 1–4 is an eight cylinder engine. As previously indicated, four first cylinders 14 have axes disposed in equal annularly spaced relation about the longitudinal axis of the housing assembly 12 within an outer circle. Four second cylinders 14' have axes disposed in equal annularly spaced relation about the longitudinal axis of the housing assembly 12 between the axes of the first cylinders 14 and within an inner circle. The surfaces of the first inlet and outlet annular cams 34, 34' and 38, 38' are formed so that each pair of inlet and outlet pistons 26, 26' and 28, 28' undergo two complete cyclical movements during a single revolution of the rotor structure 30.

As best shown in FIG. 4, with the dual cyclical movement cam surface configuration the first inlet and outlet pistons 26 and 28 in any two diametrically opposed first cylinders 14 will undergo transfer cycle movements at the same time. The cam surfaces of the second inlet and outlet annular cams 34' and 38' are of similar dual cyclical movement configuration so that the second inlet and outlet pistons 26' and 28' in an adjacent two diametrically opposed second cylinders 14' will undergo transfer cycle moments at the same time. The cam surfaces of the second inlet and outlet cams 34 and 38 and are timed with respect to the cam surfaces of the first inlet and outlet annular cams 34 and 38 in a 45° displaced phase relationship, so that the two transfer cycles per revolution of the second inlet and outlet pistons 26' and 28' will take place simultaneously with the two transfer cycle movements per revolution of the first inlet and outlet pistons 26 and 28. Since the second inlet and outlet ports 18' and 24' are axially opposite the first inlet and outlet ports 18 and 24,' the transfer cycle movements of the diametrically opposed second inlet and outlet pistons 26' and 28' move in an axially opposite direction with respect to the direction of movement of the diametrically opposed first inlet and outlet pistons 26 and 28. In this way, all of the transfer cycle movements are balanced axially so long as the relative masses are made to be equal.

In this regard, it will be noted that the added mass length of the first inlet and outlet cam followers 32 and 44 can be counterbalanced (1) by making the second inlet and outlet pistons 26' and 28' solid while the first inlet and outlet pistons 26 and 28 are hollow and (2) by making the guide blocks 40' and 52' appropriately larger than the guide block 40 and 52.

Similarly, it can be seen that the individually imbalanced intake and exhaust cycle movements also are performed simultaneously so as to achieve axial balance. This relationship also establishes that the moment between the forces created in any two adjacent cylinders will be balanced by the moment created in the diametrically opposed adjacent cylinders. In this way, full dynamic balance is obtained by insuring that the masses of the individual pistons and cam followers are the same, as aforesaid.

In accordance with the principles of the present invention, it is the mounting of the first and second cylinders 14 and 14' in annular spaced relation with respect to one another together with the reversal of the port orientation of the first and second cylinders 14 and 14' and the timing of the five cycle movements which enable full dynamic balance to be achieved. A minimum axial dimension of the engine 10 would be achieved by mounting the first and second cylinders 14 and 14' axially within the housing assembly 12 in total axial coextensive relation. In the preferred embodiment described above, the first and second cylinders 14 and 14' are axially displaced somewhat from a full axial coextensive relationship so as to accommodate the provision of inlet and outlet chambers for the first and second cylinders 14 and 14'. In its broadest aspects, the invention contemplates the full coextensive relationship as well as a greater amount of axial displacement as between the first and second cylinders 14 and 14' limited only by the desire to limit the growth of the axial extent of the housing assembly 12.

While it is contemplated in the broadest aspects of the present invention that the first and second cylinders 14 and 14' could be rotated with the rotor structure 30 and the first and second inlet and outlet annular cams, 38, 38' and 50 and 50' fixed with respect to the housing assembly 12, it is preferable in accordance with the principles of the present invention to fix the first and second inlet and outlet annular cams 38, 38' and 50, 50' to the rotor structure 30 so that they rotate therewith and to fix the first and second cylinders 14 and 14' with respect to the housing assembly 12.

It will be understood that the housing assembly 12 may assume different constructions. In the exemplary embodiment shown in FIGS. 1–3 of the drawings, the housing assembly 12 includes a pair of cup-shaped end housing members 56 and 56' which are disposed in spaced relation opening toward one another.

Fixed to the open ends of the end housing members 56 and 56' is a pair of outer housing members 58 and 58' which, in turn, are fixed to a pair of intermediate housing members 60 and 60' which, in turn, are fixed to a pair of inner housing members 62 and 62' fixed to one another. A first one of the outer housing members 58 includes four cylinder portions 64 and four openings 66 recessed to axially receive therein marginal edges of the inlet end portions 16 of the four first cylinders 14 and marginal edges of the outlet end portions 22' of the four second cylinders 14' respectively. The second outer housing member 58' includes four cylinder portions 64' and four openings 66' recessed to receive therein marginal edges of the inlet end portions of 16' of the four second cylinders 14' and the marginal edges of the outlet end portions 22 of the four first cylinders 14 respectively.

The intermediate housing members 60 and 60' have first and second exhaust openings 68 and 68' respectively formed in the peripheries thereof and are apertured to receive the first and second cylindrical portions 64, 64' and the first and second cylinders 14, 14' respectively therethrough. The intermediate housing members 60 and 60' are configured to form with the adjacent outer housing members 58, 58' first and second intake chambers 70' and 70 respectively, which communicate with outlet ports 24 and 24' respectively.

The inner housing members 62 and 62' are formed with intake openings 72 and 72' respectively in the peripheries thereof and are apertured to receive the first and second cylinders 14 and 14' therethrough. The inner housing members 62' and 62' are configured to cooperate with the intermediate housing members 60 and 60' to form intake chambers 74 and 74' respectively which communicate with the first and second outlet ports 24 and 24', respectively.

The periphery of a first one of the inner housing members 62 is also apertured to have mounted therein four suitable fuel injector mechanisms illustrated schematically at 76 in FIG. 1 which also extends into communicating relation with the central working portions 20 of the first cylinders 14. Similarly, the periphery of the second inner housing member 62 is apertured to have mounted therein four annularly spaced fuel injector mechanisms illustrated schematically at 76' in FIG. 3 which also extend into communicating relation with the central working portions 20' of the second cylinders 14'. While the preferred engine shown is a diesel type engine it will be understood that other known types of ignitions, are contemplated as, for example, spark ignition.

As shown, the rotor structure 30 is in the form of a main output shaft 78 suitably journaled in the housing assembly 12 for rotational movement about the longitudinal axis of the housing assembly 12. The first and second inlet and outlet cams 38, 38' and 50, 50' are suitably splined to or otherwise fixed to the shaft 78. It will be understood that first inlet cam 38 could be made integral with second outlet cam 50' and second inlet cam 38' could be made integral with first outlet cam 50.

Operation of the Engine of FIGS. 1–4

Referring to FIG. 2, it can be seen that for purposes of further identification the four first cylinders 14 have been numbered clockwise with the numbers 14A, 14B, 14C and 14D respectively. Likewise, the four second cylinders have been numbered 14' A, 14' B, 14°C, and 14' D respectively. These distinctive numbers are used to distinguish the operational movements taking place in each cylinder assuming a clockwise rotation of the rotor structure 30 as viewed in FIG. 2.

FIG. 4 illustrates the layout of a preferred configuration of the first inlet and outlet cams 38 and 50 outermost and of the second inlet and outlet cams 38' and 50' innermost. In addition, FIG. 4 illustrates one position of the pistons with respect to each of the eight cylinders. It will be noted that in FIG. 4, the first pistons 26 and 28 in first cylinder 14A are just beginning the power cycle and that the first pistons 26 and 28 in the next first cylinder 14B are in the middle of the transfer cycle movement. The first pistons 26 and 28 in the next two first cylinders 14C and 14D are in these same two cyclical movements respectively. Thus, it can be seen that the first pistons 26 and 28 in each pair of diametrically opposed first cylinders 14A and 14C or 14B and 14D are undergoing simultaneously the same cyclical movements.

It will also be seen that the second pistons 26' and 28' are also undergoing similar cyclical movements so that in second cylinders 14' A and 14' C, the second pistons therein are in the middle of the transfer cycle of movement and in second cylinders 14' B and 14' D, the second pistons therein are at the beginning of the power cycle.

In the positions shown in FIG. 4, it can be seen that the transfer piston movements in first cylinders 14B and 14D are axially counterbalanced by the transfer piston movements in second cylinders 14' A and 14' C since the first piston transfer movement takes place in an opposite axial direction with respect to the second piston transfer movement. In the positions shown in FIG. 4, the pistons in four cylinders are undergoing the same transfer cycle movements and the pistons in the other four cylinders are beginning to undergo power cycle movements which are exactly balanced by equal and opposite movements of each pair of inlet and outlet pistons. Thus, it can be seen that the moments created between each pair of first pistons undergoing transfer cycle movements with respect to the adjacent pair of second pistons undergoing transfer cycle movements are equal and opposite.

It can be seen as the pistons in each cylinder continues to move successively through each of the five cycles of movement, this same condition of balance occurs. However, since there are five cycles performed during each half revolution of the rotors structure 30, the timing of the cycles will be different.

With the cyclical movement shown in FIG. 4, the following timing is utilized, it being understood that axial balance occurs even though modified timing and movements may be provided. In the embodiment shown, the transfer cycles takes place in 30° of rotational movement of the rotor structure. The intake cycle takes place in the 40° of rotational movement of the rotor structure 30. The compression and power cycle movements consume 20° and 30° respectively with a dwell period of 10° therebetween. Finally, the 5 cycles of movement are completed by an exhaust cycle movement during 50° of rotational movement of the rotor structure 30.

Again it will be noted that the individually axially imbalanced movements of each pair of pistons during the intake and exhaust cycles of movement are axially balanced in the same manner as the individually axially imbalanced movements of each pair of pistons during the transfer cycle movements.

The movement of the inlet and outlet pistons in each cylinder in the transition between the end of the intake cycle of movement and the start of the compression cycle of movement can be accomplished in any of the three ways, as disclosed in my aforesaid '334 patent. The preferred transitional movement illustrated by the cam curves in FIG. 4 is exemplified by the compression positions shown in FIG. 5. It will be noted that the inlet piston 26 has just reached the cut-off position thereof while the outlet piston 28 has moved through the cylinder to a position inwardly of the cut-off position thereof. This compression position enables the engine to operate with a greater expansion volume than compression volume which is desirable from an efficiency standpoint.

Figure 6:
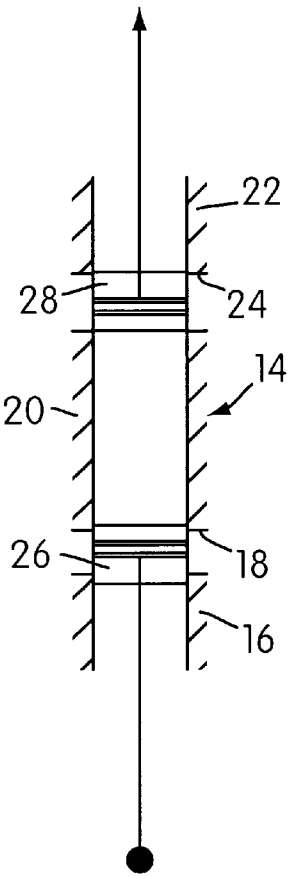
FIG. 6 is a view similar to FIG. 5 showing the inlet and outlet pistons in another combustion position thereof in accordance with the principles of the present invention.

FIG. 6 illustrates another compression position of the pistons 26, 26' and 28, 28' in which each is at its cut-off position. In this mode of operation, a maximum compression volume is provided for maximum power.

Figure 7:
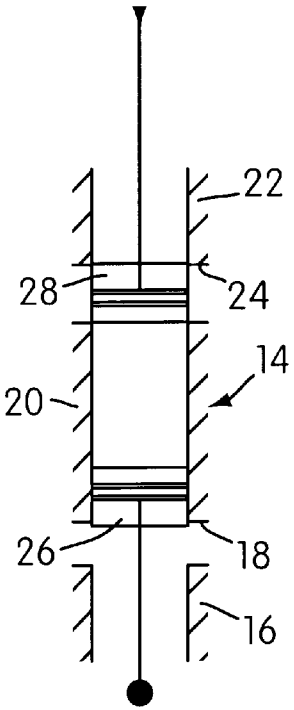
FIG. 7 is a view similar to FIG. 5 showing still another combustion position of the inlet and outlet position in accordance with the principles of the present invention.

FIG. 7 illustrates still another compression position of the pistons 26, 26' and 28, 28' wherein the inlet piston 26, 26' has been moved into the cylinder beyond its cut-off position and the outlet piston 28, 28' is at the cut-off position thereof. It will be understood that during the movement of the inlet piston 26, 26' into the cylinder 14, 14' past the cut-off position thereof, the outlet piston 28, 28' is in an open position allowing the inlet piston 26, 26' during its movement into the cylinder 14, 14' to displace a volume of air through the outlet port 24, 24'. This mode of operation dilutes the percentage of unwanted products of combustion contained in the exhaust gases and also provides for greater expansion than compression.

Figure 8:
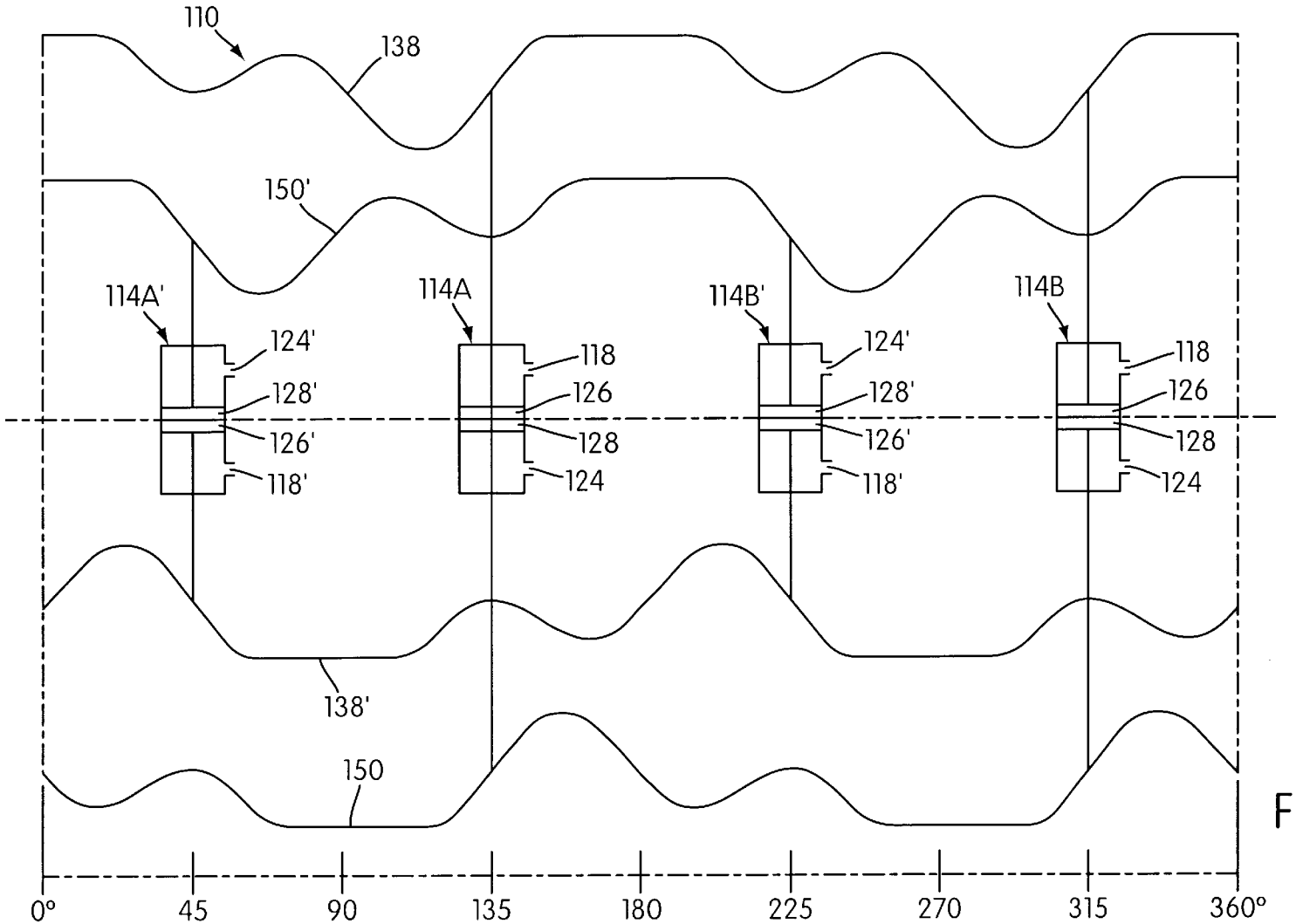
FIG. 8 is a view similar to FIG. 4 showing a modification wherein the engine includes only four cylinders rather than eight.

FIG. 8 illustrates a modification of the engine 10 constructed in accordance with the principles of the present invention. As shown, the modification consists in providing an engine 110 which is constructed exactly like the engine 10 except that there are provided only four cylinders instead of eight. Thus, there are two diametrically opposed first cylinders 114 and 114B similar to the four first cylinders 14 A–D and two equally annularly spaced diametrically opposed second cylinders 114' A and 114' B similar to the four second cylinders 14' A–D. Instead of the axes of the first cylinders 114 being disposed within a circle outside of a circle within which the axes of the second cylinders 114' are located, all four first and second cylinders 114 and 114' can have their axes disposed within the same circle.

FIG. 8 illustrates that, as before, the first inlet and outlet ports 118 and 124 of the two first cylinders 114 are axially reversed in relation to the second inlet and outlet ports 118' and 124'.

In the operation of the engine 110 it can be seen that the 5 cyclic movements of the pistons 126 and 128 in the cylinders 114 move essentially in unison in essentially the same manner as previously described. Thus, as the inlet and outlet pistons 126 and 128 in the two diametrically opposed first cylinders 114 move through a transfer cycle of movement in one axial direction, the inlet and outlet pistons 126' and 128' in the two 90° displaced diametrically opposed second cylinders 114' also undertake a transfer movement but in the axially opposite direction. This simultaneous opposed axial movement, as before, not only achieves axial balance but a balance of the moments about the longitudinal axis created by the piston movements in adjacent cylinders. A similar full balance can be achieved by providing six cylinders with the cams modified to provide three five cycle movements per revolution.

Figure 9:
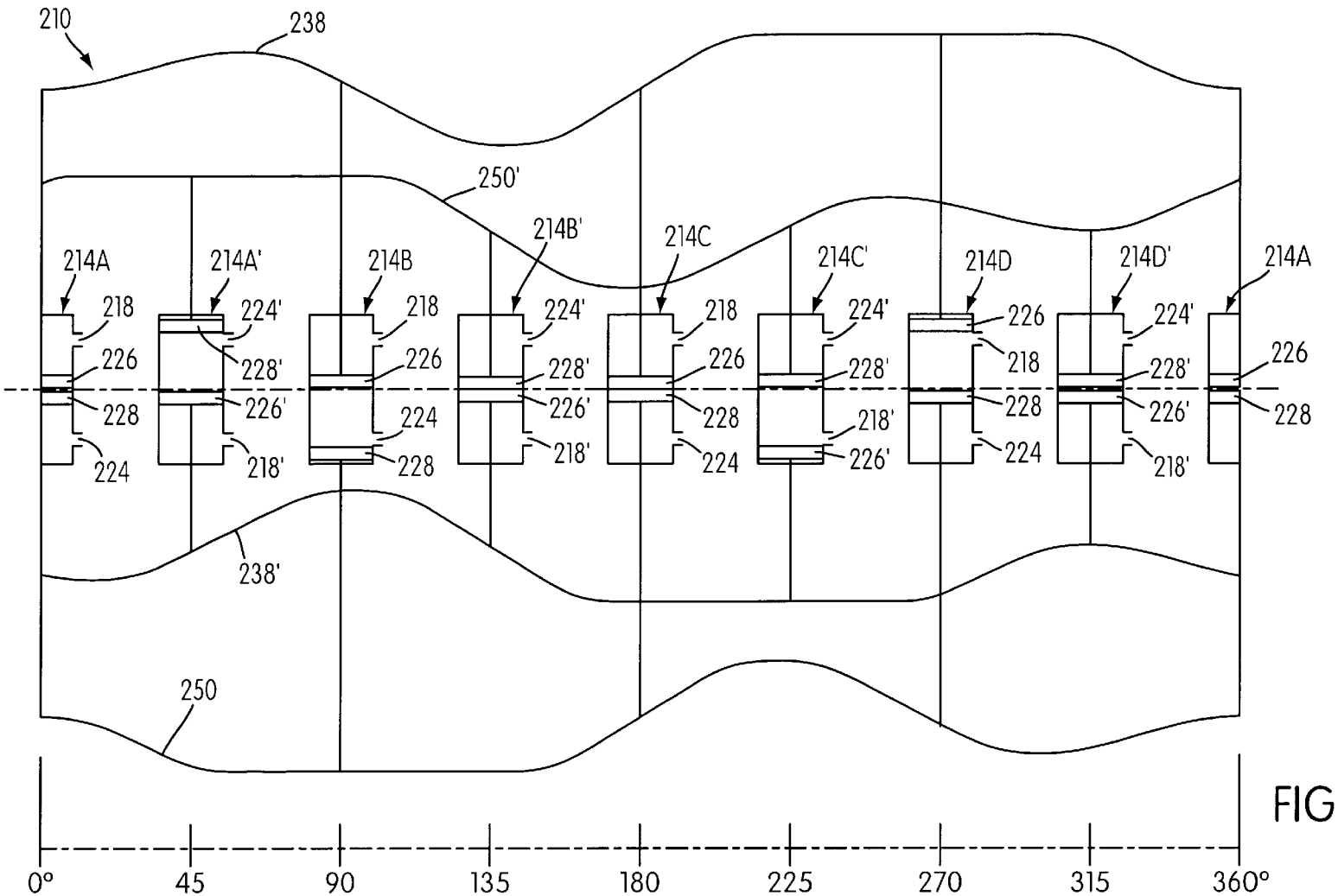
FIG. 9 is a view similar to FIG. 4 showing a modified cam surface configuration wherein only one five cycle movement is undertaken during each revolution.

FIG. 9 illustrates still another modification of the engine 10 constructed in accordance with the principles of the present invention. As shown, this modification consists in providing an engine 210 having first and second inlet cams 238 and 238' and corresponding first and second outlet cams 250 and 250' configured to move the inlet and outlet pistons 226, 226' and 228, 228' through only one five cycle movement during each revolution rather that two as before.

With this cam configuration, the first inlet and outlet pistons 226 and 228 in only one of the four first cylinders 214 will undergo a transfer cycle movement at only one time during each revolution. However, for each such transfer cycle movement there will be an equal axially opposite transfer cycle movement by the second inlet and outlet pistons 226' and 228' within an adjacent one of the second cylinders 214'. In this way, axial balance is achieved. However, there remains in imbalance about the longitudinal axis because the movements created by first and second inlet and outlet pistons 226, 226' and 228, 228' in adjacent first and second cylinders 214 and 214' are not balanced about the longitudinal axis because the piston movements occurring in any two adjacent cylinders 214 and 214' are different from the piston movements taking place on the diametrically opposed two adjacent cylinders 214 and 214'. However, since the lever arms between adjacent cylinders are relatively short, the piston movements remain axially balanced and substantially balanced overall but without the moment balance of the engine 10 and 110 previously described.

Figure 10:
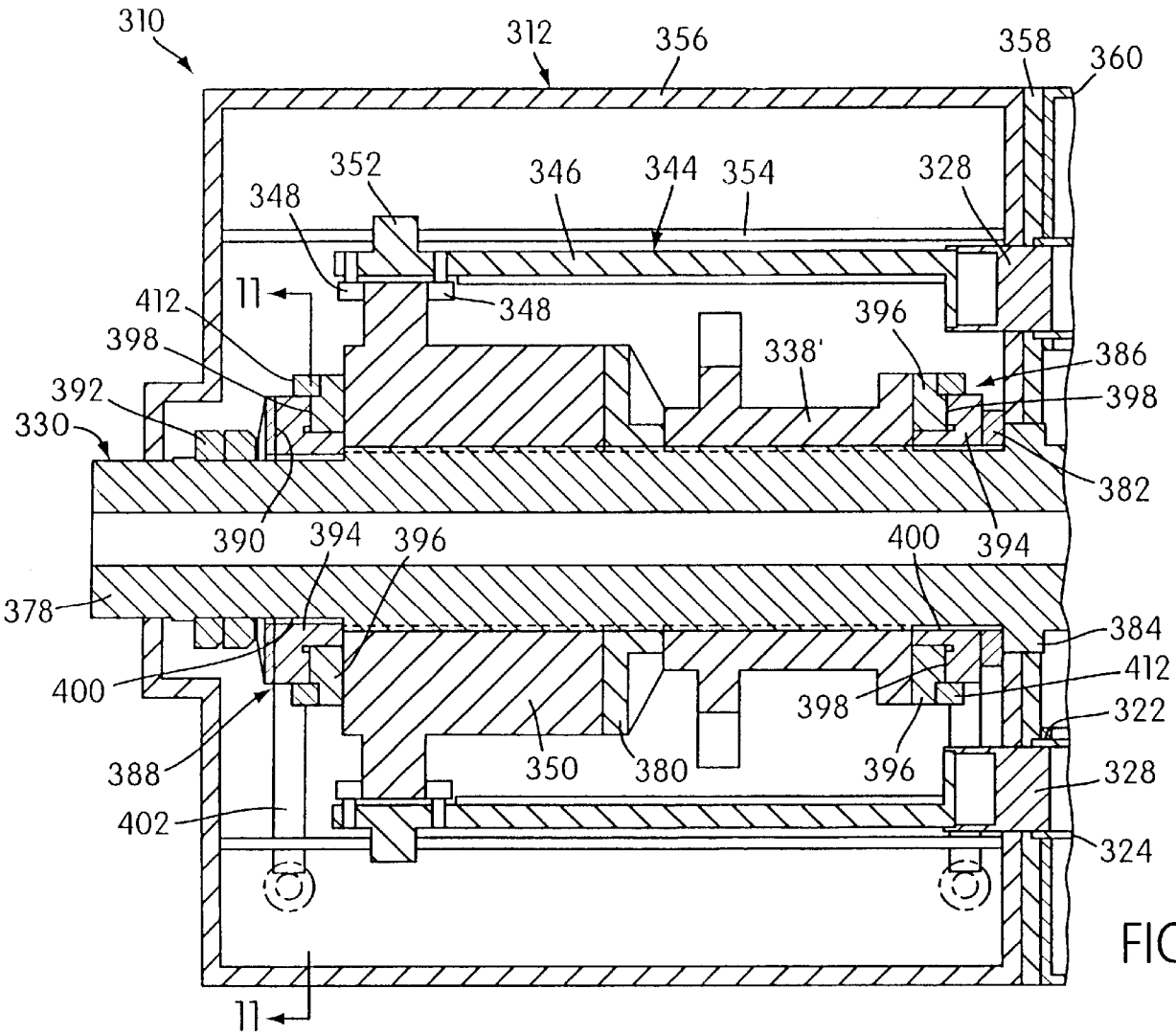
FIG. 10 is a view similar to half of FIG. 2 showing a modified construction suitable to provide for adjustment in the compression ratio of the engine.

FIGS. 10–13 illustrate still another modification of the engine 10 constructed in accordance with the principles of the present invention. The modification consists in providing an engine 310 having the capability of selectively varying the operating compression ratio thereof. FIG. 10 illustrates only one half of the engine 310, it being understood that the other half is an image thereof just like the engine 10. Consequently, a description of the half shown should suffice to give an understanding of both halves.

The engine 310 is like the engine 10 in many respects and corresponding parts are indicated by preceding the reference numbers of the engine 10 with the number 3. Thus, unless hereinafter described as differing from the engine 10, the engine 310 is like the engine 10. The basic difference between engine 310 and engine 10 is in the manner in which the inlet and outlet cams 338, 338' and 350, 350' are mounted within the engine 310. Whereas the first inlet and outlet cams 38 and 50 and the second inlet and outlet cams 38 and 50' of the engine 10 are fixed in axially spaced relation on the output shaft 78, as shown in FIG. 10, the first inlet and outlet cams 338 (not shown in FIG. 10) and 350 are splined to the output shaft 378 for rotational movement therewith and for limited axial movement with respect to the shaft 378. It will be understood that the inlet and outlet cams 338 and 350' (not shown in FIG. 10) are similarly mounted on the output shaft 378 on the opposite side of the central housing members 358, 360 and 362 from the inlet and outlet cams 338' and 350 shown in FIG. 10. It will be understood that the description of the mounting of second inlet cam 338' and first outlet cam 350 set forth below applies equally to the first inlet cam 338 and second outlet cam 350'.

As best shown in FIG. 10, the separate inlet and outlet cams 338' and 350 are splined to the output shaft 378 on opposite sides of a central thrust ring 380 capable of being moved axially with respect to the output shaft 378. An inner thrust ring 382 is mounted on the output shaft 378 in abutting relation to an inner flange 384 formed on the output shaft 378.

Mounted on the output shaft 378 between the inner thrust ring 382 and the second inlet cam 338' is a power operated inner cam moving assembly, generally indicated at 386. A similar outer cam moving assembly, generally indicated at 388, is mounted on the output shaft 378 between the first outlet cam 350 and an outer thrust ring 390. The outer thrust ring 390 is retained on the output shaft 378 by a pair of threaded rings 392 threadedly engaged on the adjacent end portion of the output shaft 378.

The power operated inner and outer cam moving assemblies 386 and 388 are of similar mirror image construction so that a description of the power operated outer cam moving assembly 388 should be sufficient to provide an understanding of the power operated inner cam moving assembly 386 as well.

Figure 11:
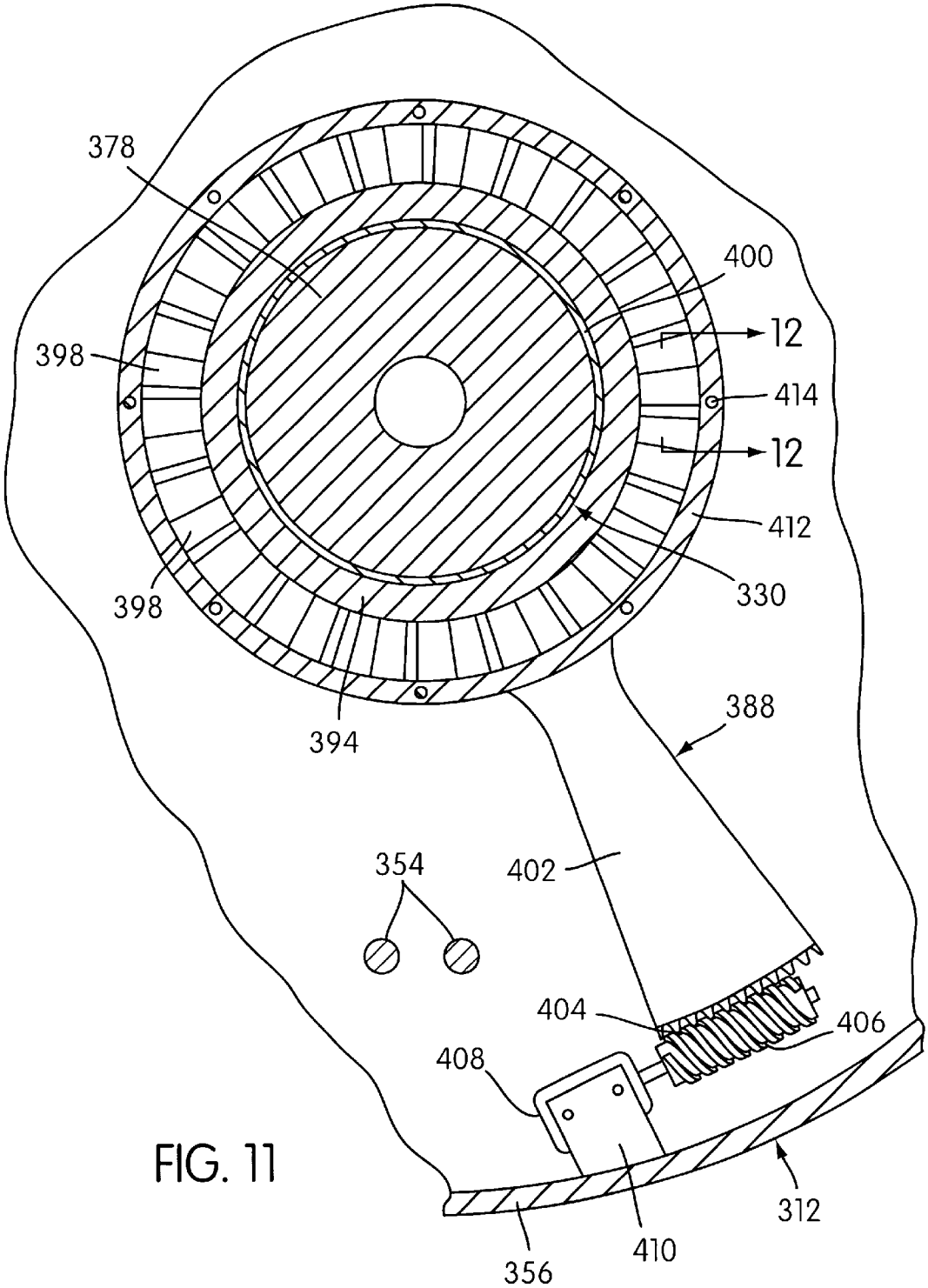
FIG. 11 is a sectional view taken along the line 11—11 of FIG. 10.
Figure 12:
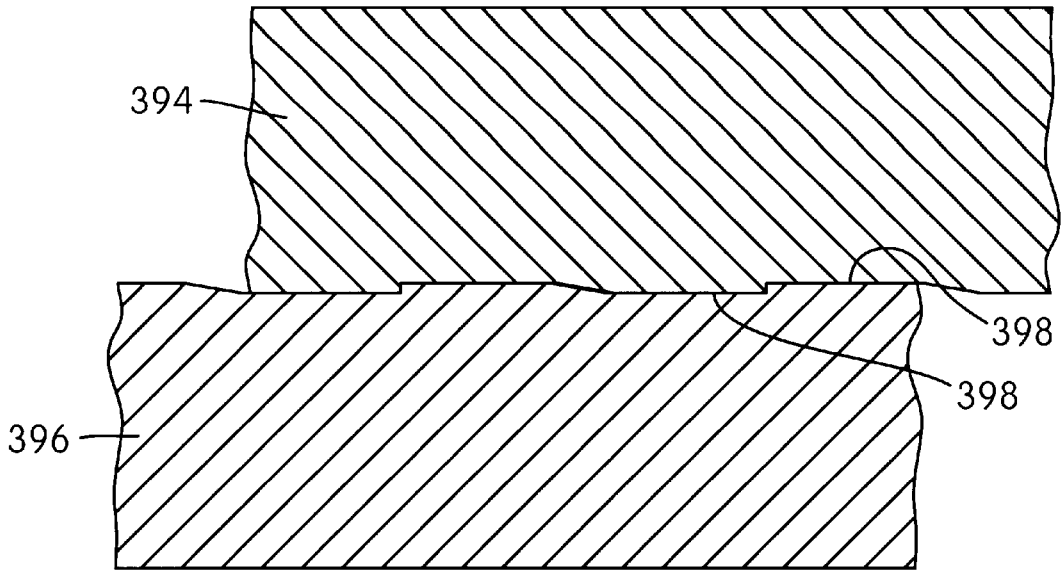
FIG. 12 is an enlarged fragmentary sectional view taken along the line 12—12 of FIG. 11 showing a pair of cam moving members in a teeth interengaging position.
Figure 13:
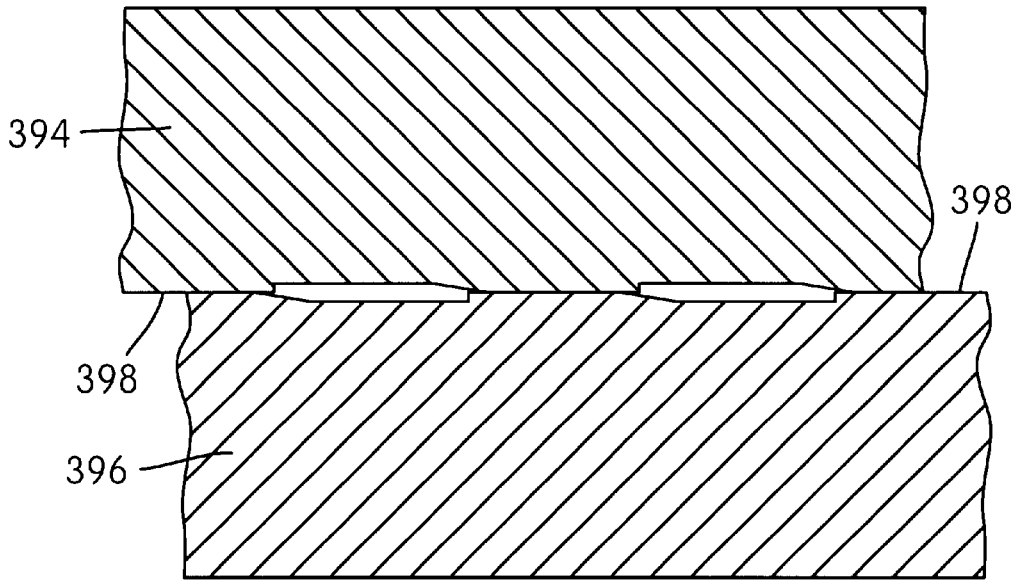
FIG. 13 is a view similar to FIG. 12 showing a pair of cam moving members in a teeth meshing position.

As best shown in FIGS. 10–13, the power operated outer cam moving assembly 388 includes a pair of cooperating annular cam moving members 394 and 396. As best shown in FIGS. 11–13, the pair of cooperating cam moving members 394 and 396 have opposite faces formed with intermeshing flat shallow teeth 398 configured to have one sloping side and one straight side. Cam moving member 394 is rotatably mounted on the output shaft 378 as by sleeve bearing 400 and includes an arm 402 extending radially outwardly therefrom.

As best shown in FIG. 11, the extremity of the arm 402 has formed thereon an arcuate series of gear teeth 404. Gear teeth 404 mesh with a driving worm gear 406 which is mounted on the output shaft of an electric motor and reduction gear unit 408 suitably mounted in fixed relation to the housing assembly 12, as by a bracket 410.

The other cam moving member 396 is fixed to the outlet cam 350 as by a securing ring 412 bolted to the outlet cam 350 by bolts 414 extending through the securing ring 412 and the cam moving member 396 and threaded into the outlet cam 350. The securing ring 412 also serves to slidably engage the periphery of the movable cam moving member 394.

The pair of cam moving members 394 and 396 of the outer cam moving assembly 388 is normally retained in a teeth interengaging position, as shown in FIGS. 11 and 12, whereas the pair of cam moving members 394 and 396 of the outlet cam moving assembly 386, is normally retained in a teeth meshing position as shown in FIG. 13. With inner cam moving assemblies 386, and outer cam moving assemblies 388 on each side of the engine 310 in these respective positions, the relationship of the surfaces of the first inlet and outlet cams 338 and 350 and the relationship of the surfaces of the second inlet and outlet cams 338' and 350' is as shown in FIG. 4. Compression ratio adjustment can be obtained by operating the electric motor gear reduction units 408 so as to move the first outlet cam 350 and second inlet cam 338 on one side of the engine together to the left as shown in FIG. 10 while the first inlet cam 338 and second outlet cam 350' on the other side of the engine 310 are moved together to the right. The effect of this movement is to cause the position of each pair of inlet and outlet pistons 326, 326' and 328, 328' to be spaced apart a greater distance at their combustion position at the end of the compression cycle of movement. Since substantially the same amount of inlet air is trapped in each cylinder 314, 314' at the beginning of the compression cycle of movement, the compression ratio is reduced.

In the embodiment shown, the operation is such that only two different compression ratios can be obtained. A typical example in the difference between the two different compression ratios is the difference between a compression ratio of 14 and a compression ratio of 23.

The increase in the axial spacing between each pair of the inlet and outlet cams does not effect the dynamic balance, but has other effects as well. For example, each pair of inlet and outlet pistons when undertaking the transfer cycle movement are spaced apart more than in the FIG. 4 mode so that there is a slight loss in the positive displacement of the gases at the end of the exhaust cycle movement and at the beginning of the intake cycle movement. In addition, the inlet and outlet end portions of the cylinders can be provided with small extensions to accommodate the axial outward movement of the inlet and outlet pistons.

It will be understood that since the inlet cam 338' and outlet cam 350 are moved axially together, they need not be separated as shown.

In the embodiment shown in FIGS. 10–12, movement of the power operated cam moving assemblies 386 and 388 to achieve movement from the normal position shown in FIG. 4 into the other reduced compression ratio position is as follows. Basically, the pair of electric motor and gear reduction units 408 operating the cam moving assemblies 386 and 388 on each side of the engine 310 must be sequentially actuated. For this purpose, computer control is contemplated capable of automatically carrying out the sequence in response to an input signal such as a manually operated switch or a switch controlled by the main operating computer of the automobile or engine control unit in response to an operating event where a change in compression ratio is desirable.

The sequence required is to first actuate the electric motor and gear reduction unit 402 of the outer cam moving assembly 388 on each side of the engine 310 having the cam moving members 394 and 396 thereof in teeth engaging relation as shown in FIG. 11. At the point after actuation when the flats of the teeth 398 are moving out of interengagement, the other electric motor and gear reduction unit 408 of the inner cam moving assembly 386 on each side of the engine is actuated so that a short period of simultaneous movement takes place as the sloping sides of the teeth 398 move past one another. At the end of this mutual movement, the teeth 398 that are associated with the outer cam moving assemblies 388 having the initially actuated units 408 are in meshing relation, as shown in FIG. 12, and the initial motor units 408 are switched off. The two other motor units 408 are allowed to continue their movement until the associated teeth 398 move into full abutting relation, as shown in FIG. 11, after which the other motor units 408 are switched off. It will be understood that rather having a short period of mutual movement, the entire movement of the initial motor unit 408 could be completed before the movement of the second motor units begin.

While the provision of two sets of inner and outer power operated cam moving assemblies 386 and 388, one set on each side of the engine, is preferred as described above, it is possible to achieve compression ratio orientation in accordance with the principles of the present invention by utilizing only one set of inner and outer power operated cam moving assemblies 386 and 388.

Figure 14:
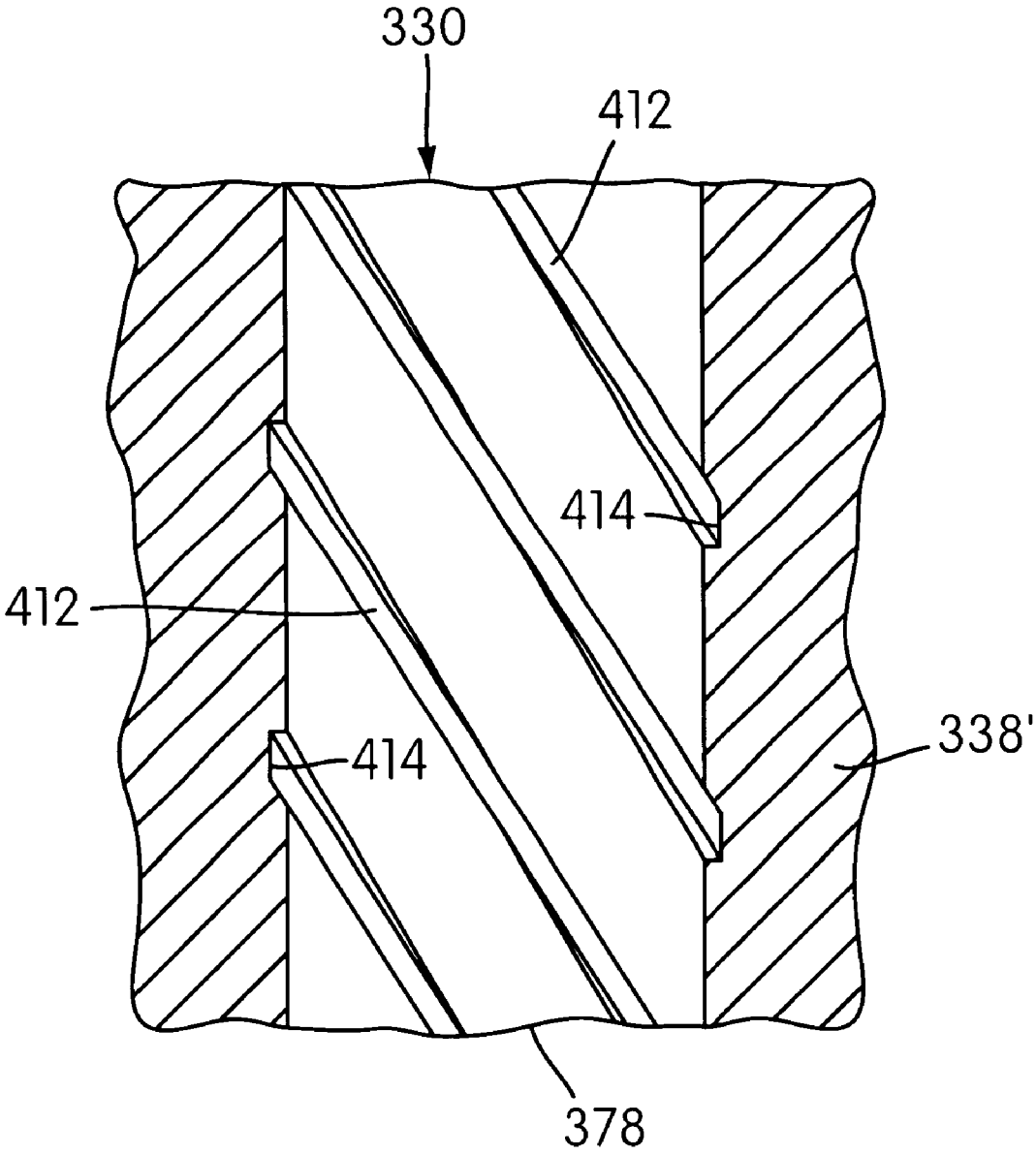
FIG. 14 is a fragmentary view partly broken away showing a modification of the structure shown in FIG. 12 enabling each cooperating pair of inlet and outlet cams to be moved toward and away from each other with both an axial and angular movement.

FIG. 14 shows a variation of the construction shown in FIGS. 10–13 wherein during the axially outward movement of the pairs of first and second inlet and outlet cams sufficient relative angular movement is imparted between each pair to bring each pair of first and second inlet and outlet pistons back together for the transfer cycle movement. The angular movement changes the phase between the two pairs of inlet and outlet cams and introduces some dynamic imbalance but substantial dynamic balance is maintained because the change in angular movement is slight.

FIG. 14 illustrates a simple structure change capable of achieving the added angular movement. As shown, the spline connection between the shaft 378 and each of the first and second inlet cams 338 and 338' is changed from a conventional spline connection to one having helical shaft splines 412 engaged within conforming helical cam grooves 414.

To accommodate the added angular movements, the electric motor and reduction gear units 408 are chosen to be variable speed units and the computer control is programmed to angularly move the movable cam members 394 whenever axial and angular movement is taking place with the cam members 394 and 396 in teeth meshing relation.

The disclosure of any patent or patent application identified by number heretofore is hereby incorporated by reference into the present specification.

What is claimed is:

1. A five cycle internal combustion engine comprising:

a housing assembly having a longitudinal axis, a plurality of first cylinders in said housing assembly having parallel axes disposed in annularly spaced relation about said longitudinal axis, a plurality of second cylinders in said housing assembly having parallel axes disposed in annularly spaced relation about said longitudinal axis and in annularly spaced relation with respect to the axes of said first cylinders, each of said plurality of first and second cylinders including an inlet end portion having an inlet port therein, a central working portion and an outlet end portion having an outlet port therein, the inlet end portion and the outlet end portion of said plurality of first cylinders being arranged in axially opposite relation with respect to the inlet end portion, and the outlet end portion of said plurality of second cylinders respectively, a first inlet piston mounted in each first cylinder constructed and arranged to be moved in sealing relation to the associated first cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, a second inlet piston mounted in each second cylinder constructed and arranged to be moved in sealing relation to the associated second cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, a first outlet piston mounted in each first cylinder constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, a second outlet piston mounted in each second cylinder constructed and arranged to be moved in sealing relation to the associated second cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, rotor structure within said housing assembly constructed and arranged to move with a rotational movement about said longitudinal axis, a first annular inlet cam disposed annularly about said longitudinal axis axially outwardly of the inlet end portions of said first cylinders, a first inlet cam follower operatively connected between said first annular inlet cam and each of said first inlet pistons so as to effect axial movements thereof in opposite directions during the rotation of the rotor structure about said longitudinal axis, a second annular inlet cam disposed annularly about said longitudinal axis axially outwardly of the inlet end portions of said second axis cylinders, a second inlet cam follower operatively connected between said second annular inlet cam and each of said second inlet pistons so as to effect axial movements thereof in opposite directions during the rotation of the rotor structure about said longitudinal axis, a first annular outlet cam disposed annularly about said longitudinal axis axially outwardly of the outlet end portions of said first cylinders, a first outlet cam follower operatively connected between said first annular outlet cam and each of said first outlet pistons so as to effect axial movements thereof in opposite directions during the rotation of the rotor structure about said longitudinal axis, a second annular outlet cam disposed annularly about said longitudinally axis axially outwardly of the outlet end portions of said second cylinders, a second outlet cam follower operatively connected between said first annular outlet cam and each of said first outlet pistons so as to effect axial movements thereof in opposite directions during the rotation of the rotor structure about said longitudinal axis, said first and second inlet and outlet annular cams being configured to move the first and second inlet and outlet pistons respectively within each cylinder through a successive five cycle repeating movement which includes (1) a power cycle wherein said first and second inlet and outlet pistons are moved axially outwardly from combustion positions disposed in closely spaced relation within the working portion of the associated cylinders defining a minimum volume condition into a respective cut-off positions thereof defining a maximum volume condition, (2) an exhaust cycle wherein said first and second outlet pistons are moved from the outlet cut-off positions thereof into the outlet end positions thereof and said first and second inlet pistons are moved through the working portions thereof into close proximity to said first and second outlet pistons respectively, (3) a transfer cycle wherein said first and second inlet and outlet pistons are moved together in close proximity to each other through the working portion thereof, (4) an intake cycle wherein said first and second outlet pistons are initially moved through the working portions of the associated cylinders while the first and second inlet pistons respectively are in positions allowing communication of the first and second inlet ports respectively with the associated working portions with the final movement of said intake cycle resulting in said first and second inlet and outlet pistons being in compression positions spaced from the respective end positions thereof so that the communication of the respective ports are cut off from the working portion of the associated cylinder, and (5) a compression cycle wherein said first and second inlet and outlet pistons are moved from said compression positions thereof toward each other respectively into said combustion positions, the first inlet and outlet annular cams being interrelated to the second inlet and outlet annular cams such that the transfer cycle movement of each first inlet and outlet piston and an associated first inlet and outlet cam follower is accompanied by a generally equal and axially opposite transfer cycle movement of a second inlet and outlet piston and an associated second inlet and outlet cam follower so that all transfer movements of said first and second inlet and outlet pistons and the associated first and second inlet and outlet cam followers thereof are substantially axially dynamically balanced.

2. A five cycle internal combustion engine as defined in claim 1 wherein the first and second inlet and outlet cams are configured to move the associated first and second inlet and outlet pistons through two repetitive five cycle movements during each rotation of said rotor structure about the longitudinal axis of said housing assembly so that the transfer cycle movements and other cycle movements of any two diametrically opposed first or second inlet and outlet pistons take place simultaneously so as to effect axial balance and balance of the moments between adjacent cylinders about the longitudinal axis of said housing assembly.

3. A five cycle internal combustion engine as defined in claim 2 wherein there are at least two first cylinders having axes spaced equally annularly about the longitudinal axis of said housing assembly and at least two second cylinders having axes spaced equally annularly about the longitudinal axis of the housing assembly between the axes of said first cylinders.

4. A five cycle internal combustion engine as defined in claim 3 wherein the number of first cylinders is four and the number of second cylinders is four, the four first cylinders and four second cylinders having their areas disposed within inner and outer circles respectively about said longitudinal axis.

5. A five cycle internal combustion engine as defined in claim 4 wherein said first and second cylinders are generally in axially coextensive relation with respect to one another.

6. A five cycle internal combustion engine as defined in claim 5 wherein said first and second cylinders are fixed with respect to said housing assembly and said rotor assembly includes an output shaft rotatable about the longitudinal axis of said housing assembly, said first and second inlet and outlet cams being operatively fixed to said output shaft for rotation therewith.

7. A five cycle internal combustion engine as defined in claim 6 wherein each of said cam followers comprises a pair of axially spaced rollers rotatably carried by one end of an elongated piston rod fixed at an opposite end thereof to an associated piston.

8. A five cycle internal combustion engine as defined in claim 7, wherein each cam follower is guided for longitudinal rectilinear movement by a guide block fixed to the associated piston rod and slidably mounted on a pair of parallel guide rods fixed to the housing assembly.

9. A five cycle internal combustion engine as defined in claim 8 wherein in the compression positions of said first and second inlet and outlet pistons, the first and second inlet pistons are in the inlet cut-off positions thereof and said first and second outlet pistons are within the working portions of the associated first and second cylinders.

10. A five cycle internal combustion engine as defined in claim 9 wherein in the compression positions of said first and second inlet and outlet pistons, the first and second inlet and outlet pistons are in their respective cut-off positions.

11. A five cycle internal combustion engine as defined in claim 10 wherein in the compression positions of said first and second inlet and outlet pistons, the first and second inlet pistons are within the working portion of their associated first and second cylinders and said first and second outlet pistons are in the outlet cut-off position thereof.

12. A five cycle internal combustion engine as defined in claim 6 including a compression ratio adjusting system constructed and arranged to effect axial movement between said inlet and outlet annular cams so as to vary the spacing between the inlet and outlet pistons in each cylinder at the combustion positions thereof so as to vary the minimum volume condition defined thereby in relation to the volume condition defined by the compression position thereof.

13. A five cycle internal combustion engine as defined in claim 12 wherein said compression ratio adjusting system includes at least one of said first inlet and outlet cams and at least one of said second inlet and outlet cams being mounted on said rotor structure for limited longitudinal movement into a plurality of different operative positions, a first power operated cam moving assembly for effecting limited longitudinal movement of said at least one first cam into a plurality of different operative positions and a second power operated cam moving assembly for effecting limited longitudinal movement of said at least one second cam into a plurality of different operative positions, the arrangement being such that in the combustion positions of said first and second inlet and outlet pistons, they are spaced apart different distances depending upon the different operative positions of said at least one first and second cams.

14. A five cycle internal combustion engine as defined in claim 13 wherein each power operated cam moving assembly includes a pair of cooperating annular cam members having intermeshing teeth capable of being moved between a teeth meshing position and a teeth interengaging position in response to a relative angular movement therebetween and a power operated unit constructed and arranged to effect angular movements of one of said cam members, the other of said annular cam members being fixed to the associated at least one cam.

15. A five cycle internal combustion engine as defined in claim 14 wherein said power operated unit is an electric motor driving a set of speed reduction gears.

16. A five cycle internal combustion engine as defined in claim 1 wherein said first and second cylinders are generally in axially coextensive relation with one another.

17. A five cycle internal combustion engine as defined in claim 1 wherein the first and second inlet and outlet cams are configured to move the associated first and second inlet and outlet pistons through one five cycle movement during each rotation of said rotor structure about the longitudinal axis of said housing assembly so that the transfer cycle movements of any two first and second inlet and outlet pistons take place simultaneously to effect axial balance.

18. A five cycle internal combustion engine as defined in claim 1 including a compression ratio adjusting system constructed and arranged to effect axial movement between said inlet and outlet annular cams so as to vary the spacing between the inlet and outlet pistons in each cylinder at the combustion positions thereof so as to vary the minimum volume condition defined thereby in relation to the volume condition defined by the compression position thereof.

19. A five cycle internal combustion engine as defined in claim 18 wherein said compression ratio adjusting system includes at least one of said first inlet and outlet cams and at least one of said second inlet and outlet cams being mounted on said rotor structure for limited longitudinal movement into a plurality of different operative positions, a first power operated cam moving assembly for effecting limited longitudinal movement of said at least one first cam into a plurality of different operative positions and a second power operated cam moving assembly for effecting limited longitudinal movement of said at least one second cam into a plurality of different operative positions, the arrangement being such that in the combustion positions of said first and second inlet and outlet pistons, they are spaced apart different distances depending upon the different operative positions of said at least one first and second cams.

20. A five cycle internal combustion engine as defined in claim 19 wherein each power operated cam moving assembly includes a pair of cooperating annular cam members having intermeshing teeth capable of being moved between a teeth meshing position and a teeth interengaging position in response to a relative angular movement therebetween and a power operated unit constructed and arranged to effect angular movements of one of said cam members, the other of said annular cam member being fixed to the associated at least one cam.

21. A five cycle internal combustion engine as defined in claim 20 wherein said at least one first cam and said at least one second cam are also mounted for limited angular movement in addition to the limited longitudinal movement, the arrangement being such that said first and second inlet and outlet pistons remain in the same positions together during the transfer cycle movements thereof in any operative position of said at least one first and second cams.

22. A five cycle internal combustion engine comprising:

a housing assembly having a longitudinal axis, a cylinder in said housing assembly disposed in spaced relation to said longitudinal axis, said cylinder including an inlet end portion having an inlet port therein, a central working portion and an outlet end portion having an outlet port therein, an inlet piston mounted in said cylinder constructed and arranged to be moved in sealing relation to said cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, an outlet piston mounted in each cylinder constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, rotor structure within said housing assembly constructed and arranged to move with a rotational movement about said longitudinal axis, an annular inlet cam disposed annularly about said longitudinal axis, an inlet cam follower operatively connected between said annular inlet cam and said inlet piston so as to effect axial movements thereof in opposite directions during the rotation of the rotor structure about said longitudinal axis, an annular outlet cam disposed annularly about said longitudinal axis, an outlet cam follower operatively connected between said annular outlet cam and said outlet piston so as to effect axial movements thereof in opposite directions during the rotation of the rotor structure about said longitudinal axis, said inlet and outlet annular cams being configured to move the inlet and outlet pistons respectively within said cylinder through a successive five cycle repeating movement which includes (1) a power cycle wherein said inlet and outlet pistons are moved axially outwardly from combustion positions disposed in closely spaced relation within the working portion of said cylinder defining a minimum volume condition into their respective cut-off positions thereof defining a maximum volume condition, (2) an exhaust cycle wherein said outlet piston is moved from the outlet cut-off position thereof into the outlet end portion of said cylinder and said inlet piston is moved through the working portion of said cylinder into close proximity to said outlet piston, (3) a transfer cycle wherein said inlet and outlet pistons are moved together in close proximity to each other through the working portion of the associated cylinder, (4) an intake cycle wherein said outlet piston is initially moved through the working portion of said cylinder while the inlet piston is in a position allowing communication of the inlet port with the working portion of said cylinder with the final movement of said intake cycle resulting in said inlet and outlet pistons being in compression positions spaced from the respective end positions thereof so that the communication of the respective ports are cut off from the working portion of said cylinder, and (5) a compression cycle wherein said inlet and outlet pistons are moved from said compression positions thereof toward each other respectively into said combustion positions, and a compression ratio adjusting system constructed and arranged to effect axial movement between said inlet and outlet annular cams so as to vary the spacing between the inlet and outlet pistons in said cylinder at the combustion positions thereof so as to vary the minimum volume condition defined thereby in relation to the volume condition defined by the compression position thereof.

23. A five cycle internal combustion engine as defined in claim 22 wherein said compression ratio adjusting system includes said inlet and outlet cams mounted on said rotor structure for limited longitudinal movement into a plurality of different operative positions, a first power operated cam moving assembly for effecting limited longitudinal movement of said inlet cam into a plurality of different operative positions and a second power operated cam moving assembly for effecting limited longitudinal movement of said outlet cam into a plurality of different operative positions, the arrangement being such that in the combustion positions of said inlet and outlet pistons, they are spaced apart different distances depending upon the different operative positions of said inlet and outlet cams.

24. A five cycle internal combustion engine as defined in claim 22 wherein each power operated cam moving assembly includes a pair of cooperating annular cam members having intermeshing teeth capable of being moved between a teeth meshing position and a teeth interengaging position in response to a relative angular movement therebetween and a power operated unit constructed and arranged to effect angular movements of one of said cam members, the other of said annular cam members being fixed to the associated at least one cam.

25. A five cycle internal combustion engine as defined in claim 24 wherein said power operated unit is an electric motor driving a set of speed reduction gears.

26. A five cycle internal combustion engine as defined in claim 24 wherein said inlet cam and said outlet cam are also mounted for limited angular movement in addition to the limited longitudinal movement, the arrangement being such that said inlet and outlet pistons remain in the same positions together during the transfer cycle movements thereof in any operative position of said inlet and outlet cams.

27. A five cycle internal combustion engine as defined in claim 26 wherein said inlet cam and said outlet cam are connected to said rotor structure by a helical spline connection.

28. A five cycle internal combustion engine as defined in claim 22 wherein in the compression positions of said inlet and outlet pistons, the inlet piston is in the inlet cut-off position thereof and the outlet piston is within the working portion of the associated cylinder.

29. A five cycle internal combustion engine as defined in claim 22 wherein in the compression positions of said inlet and outlet pistons, the inlet and outlet pistons are in their respective cut-off positions.

30. A five cycle internal combustion engine as defined in claim 22 wherein in the compression positions of said inlet and outlet pistons, the inlet piston is within the working portion of the cylinder and the outlet piston is in the outlet cut-off position thereof.

* * * * *